United States Patent [19]

Yanagawa

[11] Patent Number: 4,944,778

[45] Date of Patent: Jul. 31, 1990

[54] ELECTROSTATIC DUST COLLECTOR

[75] Inventor: Motoo Yanagawa, Tokyo, Japan

[73] Assignee: Research Development Corporation of Japan, Tokyo, Japan

[21] Appl. No.: 389,414

[22] Filed: Jul. 13, 1987

Related U.S. Application Data

[63] Continuation of Ser. No. 754,314, Jul. 12, 1985, abandoned.

[30] Foreign Application Priority Data

May 30, 1985 [JP] Japan ..... 60-115342
May 30, 1985 [JP] Japan ..... 60-115343

[51] Int. Cl.[5] ..... B0BC 3/00

[52] U.S. Cl. ..... 55/131; 55/150; 55/155

[58] Field of Search ..... 55/131, 150, 155

[56] References Cited

U.S. PATENT DOCUMENTS

| | | | |
|---|---|---|---|
| 2,683,500 | 7/1954 | Goodloe | 55/527 X |
| 2,784,132 | 3/1957 | Maisel | 55/527 X |
| 2,868,319 | 1/1959 | Rivers | 55/155 X |
| 3,073,094 | 1/1963 | Landgraf et al. | 55/131 |
| 3,416,540 | 12/1968 | Lidums | 55/146 X |
| 3,449,094 | 6/1969 | Baxt et al. | 55/155 X |
| 3,487,610 | 1/1970 | Brown et al. | 55/155 X |
| 3,509,696 | 5/1970 | Thompson | 55/146 X |
| 3,616,604 | 11/1971 | Schouw | 55/131 X |
| 3,763,633 | 10/1973 | Soltis | 55/146 X |
| 3,970,905 | 7/1976 | Itoh et al. | 55/146 X |
| 4,234,324 | 11/1980 | Dodge, Jr. | 55/146 X |
| 4,249,919 | 2/1981 | Kalt | 55/155 X |
| 4,265,641 | 5/1981 | Natarajan | 55/155 X |
| 4,313,741 | 2/1982 | Masuda et al. | 55/155 X |

FOREIGN PATENT DOCUMENTS

| | | | |
|---|---|---|---|
| 600967 | 7/1960 | Canada | 55/155 |

*Primary Examiner*—Bernard Nozick
*Attorney, Agent, or Firm*—Armstrong, Nikaido, Marmelstein, Kubovcik & Murray

[57] ABSTRACT

An electrostatic dust collector for removing particles, such as smoke particles, pollen and the like from a gas stream passed therethrough. The dust collector includes a filter element formed of narrow strips of pliable, porous dielectric material superimposed, face to face, with electrodes therebetween and so that no air gap is formed between the face to face strips. The superimposed strip is coiled or randomly packed into a non-conductive bag, such as of nylon net, and positioned in a gas stream from which particles are to be removed and the pores of the dielectric material are charged to attract in such gas stream to the walls of the charged pores by applying a voltage to the electrodes.

5 Claims, 4 Drawing Sheets

ELECTROSTATIC DUST COLLECTOR

This application is a continuation of application Ser. No. 754,314, filed July 12, 1985, now abandoned.

BACKGROUND OF THE INVENTION

1. Field of the Invention

The present invention relates to an electrostatic dust collector which uses a porous dielectric as a diaphragm between electrodes.

2. Description of the Prior Art

To eliminate microparticles floating in exhaust gases or the like, it is common practice to use a filter device which permits the gases to pass through a porous member and to collect the particles. This system, however, involves problems that if the pores of a particle collecting material are greater than a predetermined value, it is hard to collect the particles. If the thickness of a collecting material is made larger, the resistance to the passage of fluids therethrough increases and increases the pressure loss. There is a limit in dust collecting performance in such filter devices.

On the other hand, for the purpose of eliminating air pollution from smoke or the like, an electrostatic dust collector has been used in which microparticles in gases to be eliminated are charged in a corona discharge area. The charged gas particles are passed between plates to which high voltage is applied and the charged particles are electrostatically absorbed. This system allows microparticles having a diameter of approximately $0.1\mu$ to be collected pressure loss resulting from said dust collector is very small. However, this system suffers disadvantages in that a corona discharge section and a collecting section must be provided. This results in a complex construction. Furthermore, if the collecting performance is increased, high voltage must be used or the voltage applied section has to be extended. Concentration of electric fields on a raised portion of microparticles accumulate on the plates and causes a discharge to again scatter the collected microparticles.

There is a further problem in that, if any of these devices are installed in an existing duct or the like, such device has to be specially designed to meet the size and shape of the duct.

Moreover, in such devices, as described above, the collecting plates are exposed. The durable period is extremely short if they are used in corrosive environments. Because of this, the devices have been difficult to use, not only in installations involving exhaust gases in boilers containing $SO_x$ but in hospitals, animal breeding farms and the like where formaldehyde solutions containing methanol and similar solutions are used.

SUMMARY OF THE INVENTION

The present inventor has previously developed an electrostatic dust collector, wherein electrodes are disposed on opposite surfaces of a porous dielectric, an intense electric field is applied to the porous dielectric so that even particles having a particle size smaller than the opening of the porous dielectric may be collected, and a portion between electrodes is insulated by the dielectric to eliminate a danger of discharge resulting from accumulation of collected particles. An intense electric field can be applied. (Japanese Patent Laid-Open No.19564/84). Published Aug. 31, 1985 as 60 16 7738. The present invention is an improvement over the aforesaid dust collector to make application thereof to various uses possible.

It is an object of the present invention to provide an arrangement wherein a porous dielectric is formed into pliable narrow strips, which are randomly packed into a net bag, whereby it is installed in an existing duct to be able to eliminate gases flowing through the duct irrespectively of a diameter and shape in section thereof.

It is a further object of the present invention to provide an arrangement wherein an electrode formed of an aluminum foil is adhered through a paraffin onto a porous dielectric such as urethane foam which is a filter medium, or aluminum is vaporised on the surface on which cellulose acetate or the like is coated to form an electrode and coated thereon with a high molecular liquid such as polystyrene, or an electrode coated with a high-molecular monomer liquid such as polystyrene is attached as an electrode as a foil is adhered to a high-molecular film or which is formed by vaporisation to thereby form an electrode free from direct contact with gas and thus without any danger of corrosion. The elimination of corrosive gases containing formalin and $SO_x$ is possible.

It is another object of the present invention to provide an arrangement wherein a plurality of electrodes are provided over the gas transmitting direction of a porous dielectric such as urethane foam constituting a filter element, and an electric field is repeatedly applied to the transmitting gases to thereby effectively collect microparticles which has been difficult to collect particles in the past.

DETAILED DESCRIPTION OF THE PREFERRED EMBODIMENTS

The present invention will now be described in detail with reference to the accompanying drawings.

Figure 1:
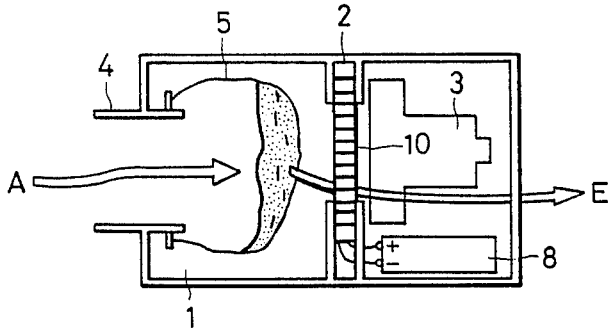
FIG. 1 is a sectional view of one embodiment of a dust collector according to the present invention.

FIG. 1 is a sectional view showing the conception of a dust collector in accordance with the present invention. A filter element 2 is disposed in the central portion of a casing 1. An intake flow A is drawn by a fan 3 and flows through an inlet 4. For reducing blinding of the filter element, a filter bag 5 is disposed to collect coarse dusts.

Figure 2:
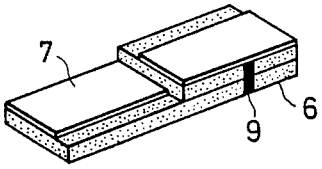
FIGS. 2 and 3 are perspective views, respectively, showing a construction of a filter element.
Figure 3:
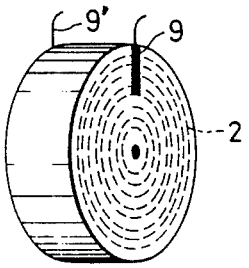

The filter element 2 is manufactured by cylindrically winding, as shown in FIGS. 2 and 3, a plurality of filter media formed with a metal film 7 such as aluminum on one surface of a porous dielectric material 6 such as urethane foam. A high voltage is applied between adjacent electrodes by a DC high voltage power source 8, FIG. 1. Filter element 2 is supported by a support net 10.

In the arrangement as described above and shown in FIG. 1, microparticles, such as dusts, floating in the air stream A are drawn through the inlet 4 by fan 3 and are physically collected in narrow holes or pores in the dielectric filter material 6 electrostatically charged. The microparticles are electrically charged and attracted to the walls of the pores or narrow holes. Therefore, a relatively small thickness of the filter element will suffice and pressure loss is minimized.

Electrodes used to apply an electric field comprise the metal films 7 formed on the porous dielectric material 6, and the electrodes apart through the thickness of the dielectric material 6 are disposed merely by winding the metal film and therefore the spaced apart electrodes can be arranged very simply and held securely. Therefore, a uniform intense electric field can be formed within the filter element.

A corona discharge section for charging dusts need not be provided, which has been necessary in conventional electrostatic dust collectors. The ratio between the length and diameter of the air stream passage is large and the charged particles are collected on passage walls by slight displacement of electrostatic attraction. Therefore, the collecting efficiency is extremely good. In addition, the portion between the electrodes is insulated by the dielectric material, and therefore no short-circuiting and discharge occur due to the accumulated dusts. Even if short-circuiting should occur, microelectrode surfaces will vaporise and the short-circuiting and discharge will terminate thus providing safety.

The thickness of the foamed dielectric material can be made small and the spacing between electrodes can be made small and applied voltage can be reduced to about one-third of that required in conventional electrostatic dust collectors.

Preferably, the filter element is produced for example in the following procedure.

Figure 4:
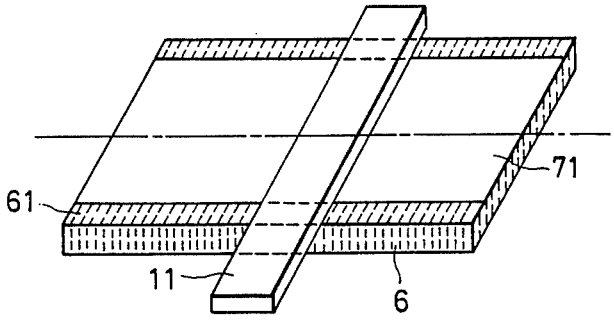
FIG. 4 illustrates a method for adhering a metal foil to a filter medium.

In the embodiment shown in FIG. 4, an aluminum foil 71 coated with paraffin is placed on one surface of a sheet 6 of dielectric foamed filter medium, heated by a heater 11 to a temperature at which the paraffin becomes molten. The paraffin coated aluminum foil surface is lightly pressed against the surface of filter medium to thereby bond the foil to the surface. The width of the aluminum foil is slightly smaller than that of the filter medium sheet, leaving portions 61 on either side to which electrode is not bonded. Thereafter, the filter medium 6 is cut along the center line thereof, and the cut portions are superposed upon each other and wound as shown in FIG. 3 to obtain the filter element 2. With this arrangement, end edges of electrodes adjacent to each other are mutually exposed at the reverse sides of the element 2. It is convenient to provide terminals 9, 9' to the side edges to apply a voltage to each of the electrodes.

Figure 5:
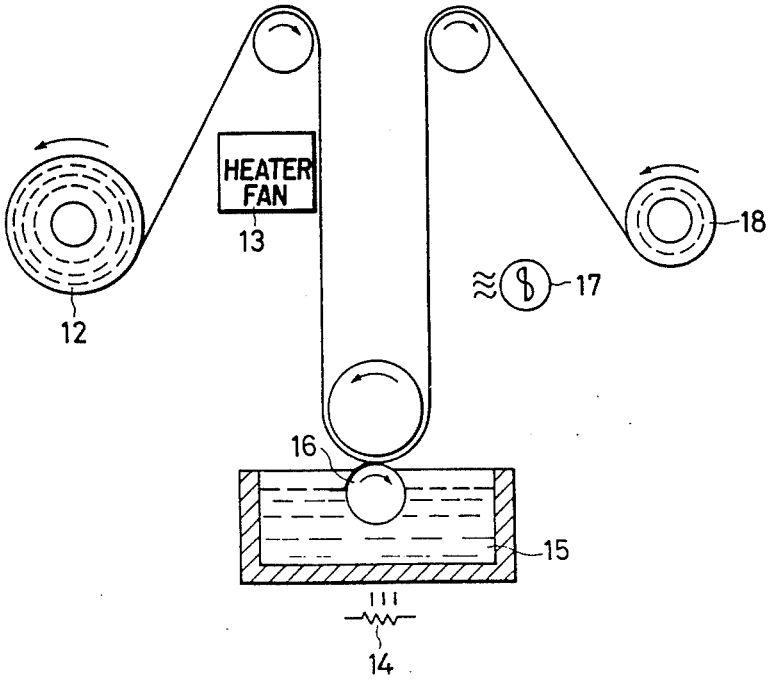
FIG. 5 is a schematic view of a device for coating a paraffin to a metal foil.

FIG. 5 illustrates one example of a device for coating paraffin on an aluminum foil. The aluminum foil drawn from an aluminum foil supply roll 12 is preheated by a preheating fan 13 and thereafter brought into contact with a coating roll 16 rotated within a paraffin bath 15 held at approximately 50° C. by a heater 14. The foil surface is entirely coated with a predetermined quantity of paraffin, cooled and solidified by a cooling fan 17 and wound onto a winding roll 18. Thereafter, the winding roll is adhered to the dielectric foamed filter medium as shown in FIG. 4. However, in the case where the manufacturing process is continuously carried out, the winding roll can be adhered to the filter medium immediately after paraffin has been coated and thereafter wound together with the filter medium. In this case, the cooling fan 17 and heater 14 can be omitted.

Formation of electrodes on the dielectric foamed filter medium is not limited to the manner of the above-described embodiment but vacuum vaporisation can be employed. In this case, preferably the surface is treated to be smooth to facilitate vaporisation, and cellulose acetate or cellulose ethyl is coated by spraying or by a roll to the thickness of dozens of microns on the surface of the filter medium. After the coated film has been dried, aluminum or zinc film is coated on the surface thereof by vacuum vaprisation.

The dust collector as described above, has an extremely simple construction and has a dust collector capacity comparable to a dust collector consisting of an electrostatic dust collector and a filter. Moreover, the filter media can be easily produced in volume as described above. If lowering in efficiency due to the blinding or the like should occurs, the filter medium may be simply changed to maintain a high dust collecting efficiency.

Because of low cost and low applied voltage, the present device can be used even in fields which have been impossible to apply the electrostatic dust collector in the past. For example, the device can be incorporated into an air heater for home use, a window fan, and the like, to collect pollen, which causes asthma, and dusts, and the like to maintain the indoor clean. The device can be utilized as an air cleaner for home use for collecting smoke of cigarettes.

Figure 6:
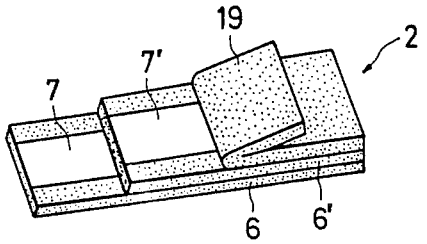
FIG. 6 is an overall view of a first embodiment of a dust collector for random packing into a duct.

FIG. 6 shows one embodiment of an improved filter element. Reference numerals 6, 6' and 19 designate porous dielectric materials formed of urethane foam or the like, which are in the form of a narrow strip having a suitable width. To one surface of the materials 6, 6' is adhered aluminum foils 7, 7' narrower than the dielectric material, with paraffin, adhesives, and the like, as described above, to form electrodes. Three dielectric materials 6, 6' and 19 are adhered to form the filter element so that the electrodes are not exposed.

Figure 7:
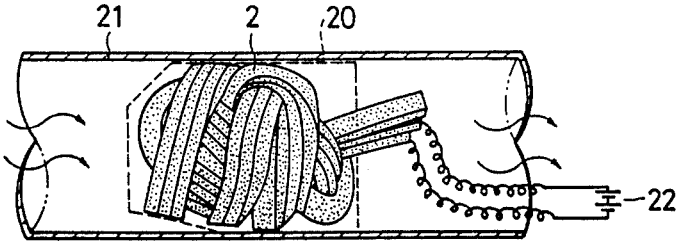
FIG. 7 is a fragmentary perspective view of one example of a filter element.

This lengthy filter element 2 is randomly forced into, for example, an insulating bag 20 such as a nylon net and forced into a duct 21, as shown in FIG. 7. A reference numeral 22 designates an electrical power source. Since the filter element 2 is pliable and has a moderate elasticity, as described above, the filter element is wholly spread inside the duct 21 to cover the entire section irrespective of the size and shape in section of the duct 21.

Under the aforesaid condition, when a voltage is applied by the power source 22 to the electrodes 7, 7', the filter element 2 exhibits a great dust collecting performance with less pressure loss different from a mere filter.

That is, the filter elements 2 randomly packed into the net bag 20 are porous themselves and form a flow-passage for exhaust gases with only a relatively small resistance to an exhaust stream flowing through the clearances. Thus, pressure loss of exhaust is small.

The dusts contained in the exhaust come into contact with the porous dielectric material forming walls of a narrow and bended passageway and are mechanically collected, charged by the adherence of ions created due to the slipping or a high voltage between electrodes, and collected and retained by the porous dielectric material by the electric field formed between electrodes.

Figure 8:
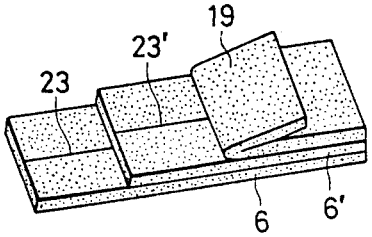
FIG. 8 is a fragmentary perspective view of another example of the filter element.

As is known, the electric field formed between electrodes is produced not only in portions where the electrodes are opposed each other but bulges towards both sides thereof and also greatly bulges externally of the porous dielectric material. Therefore, as shown in FIG. 8, the electrodes can be copper wires 23, 23' instead of foils.

With the above-described construction, this embodiment has the following characteristics:

(1) In the present invention, the filter element 2 is merely forced into the bag and spread fully over the passage for gases to be dust-eliminated such as an exhaust duct by its own resilient force. Therefore, the dust collector can be easily installed irrespective of the size and section of the existing gas passage.

(2) Since both sides of each of the electrodes are covered with the porous dielectric material, even if the filter element 2 is randomly forced, there occurs no possible short-circuiting between the electrodes, and handling thereof is extremely easy.

(3) Despite that the filter element is forced in a complicated shape, it is in the form of a narrow strip, and therefore, one terminal for application of voltage will suffice. Thus, the whole construction of the device is extremely simple.

(4) Since air can pass through the disordery spaces of the elemment 2, the resistance is small and the pressure loss is extremely small.

Figure 9:
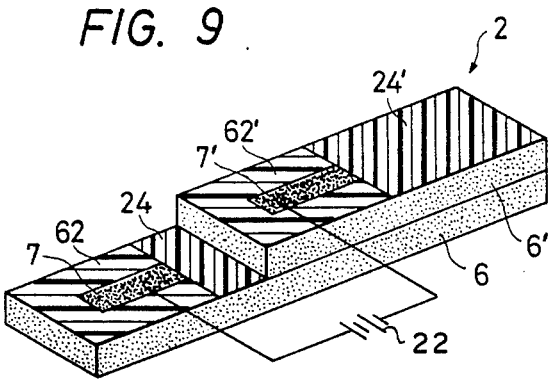
FIG. 9 is a fragmentary perspective view of one example of a filter element used under the corrosive atmosphere.

FIG. 9 shows an embodiment which is used for gases containing corrosive components. Electrodes 7, 7' are provided on porous dielectric materials 6, 6' in a manner similar to that as described in connection with FIG. 4. Paraffin coated on the electrodes 7, 7' forms a protective layer to prevent the aluminum foil of electrode from direct exposure to treated gases. However, if this is not sufficient, cellulose acetate or cellulose ethyl is applied by spraying or roll to surfaces 62, 62' of the narrow strips of the porous dielectric materials 6, 6' to further complete gas cut-off.

As described above, polystyrene liquid is coated by spraying on the narrow strips 6, 6' or roll 2, FIG. 3, formed with electrodes to form films 24, 24' to provide a complete bag-like cover to thereby prevent the electrodes 7, 7' from direct contact with the treated gas.

The aforesaid narrow strips 6, 6' are superposed to be wound into a disc-like configuration as shown in FIG. 3 or fully forced into the duct disorderly as shown in FIG. 7 and a high voltage is applied between the electrodes 7 and 7' whereby microparticles in gases passing through the element 2 can be collected in the porous dielectric. Also, terminal portions of lead electrodes can be molded by heating them at a low temperature by use of paraffin after lead wires have been fixed to easily interrupt contact thereof with exhaust gases.

In this embodiment, a unique construction in which electrodes are provided on the dielectric can be utilized to easily form gas barrier covers on both surfaces of electrodes to completely prevent the lowering of a dust collecting performance due to the corrosion of electrodes.

Furthermore, the filter element can be easily produced continuously from inexpensive materials such as urethane foam and can be of disposable type. Therefore, the filter element is suitable for eliminating gases containing corrosive components which are troublesome in treatment after collection.

Therefore, the device according to the present invention is suitable for use as a dust collector in facilities such as hospitals, animal breeding farms and the like which were not able to find suitable devices despite the fact that the necessity of such provisions has been recognized.

Figure 10:
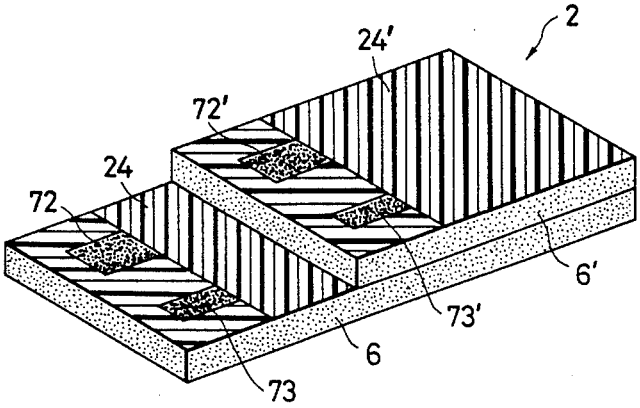
FIG. 10 is a fragmentary perspective view of one example of a filter element having a plurality of electrodes.

FIG. 10 shows an embodiment in which a plurality of electrodes are provided on narrow strips of porous dielectric to thereby enhance the collecting performance of microparticles.

Aluminum foils 72, 73; 72', 73' having a width of approximately 10 mm are attached at intervals of approximately 10 mm to one surface of a urethane foam having a thickness of approximately 10 mm and a width of approximately 50 mm, a filter is wound therefrom, said filter having narrow strips 6, 6' superposed thereon formed with films 24, 24' by spraying polystyrene liquid thereon and forming a disc-like filter element 2, such as shown in FIG. 3. Lead electrodes 9, 9' are connected to the electrodes 72, 73 and 72', 73' of the narrow strips 6, 6', respectively. The electrodes 72, 73 and 72', 73' can be of the same polarity or opposite polarity so long as one of the pair of electrodes 72,72' and one of the pair of electrodes 73,73' is positive and the other of the pair is negative. If the electrodes 72,73 are the same polarity and the electrodes 72',73' are the same polarity, the construction of the lead electrodes becomes simple.

Gases containing microparticles such as smoke is permitted to flow in a vertical direction relative to the disc of the filter element and a DC voltage of a few KV is applied between the lead electrodes to measure the collection rate of microparticles in the gases. The results obtained therefrom is as follows:

| Particle Size μ | Collection Rate |
|---|---|
| 0.3 | above 80% |

(According to to the calculation method)

Figure 11:
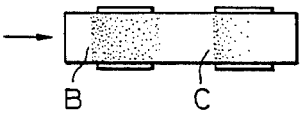
FIG. 11 illustrates the dust collecting state.

It has been found from the section of the element that as shown in FIG. 11, the microparticles are most materially collected on the electrode end B on the gas inlet side and the high rate next thereto is obtained at the second electrode end C.

Electrostatic adsorption requires the width of an electric field enough to receive an electrostatic force during the time the microparticles reach the collection surface and at the same time, needless to say, the intenser electric field, the higher the collection effect is obtained.

According to the present invention, the electrodes 3, 4, 5 and 6 comprise foils which have a predetermined width, and lines of electric force are concentrated at the end edges of the electrodes by the edge effect as is well known, at which the high collection efficiency is exhibited. Since the end edges of the electrodes are present in both edges of the plurality of electrodes, portions where the collection performance is high appear through magnification of electrodes, and the collection performance as a whole seems to be increased.

What is claimed is:

1. An electrostatic dust collector comprising a filter element formed of narrow elongated strips of pliable, porous dielectric filter material having a gas barrier film on at least one surface thereof of each strip, said narrow strips and electrodes therebetween being superimposed in face to face contact, and at least on one gas barrier film and electrode therebetween and on each strip, so that said pliable, porous dielectric filter material fills the space between the gas barrier film and electrodes with no air gap exists between said face to face strips, means for applying an electrical voltage to said electrodes for forming an electrical field therebetween in the pores of said porous dielectric filter material and means for passing gas containing particles through said strips in a stream parallel to said contacting faces and said gas barrier film therebetween and through said pores of said porous material to electrically charge said particles and to attract said charged particles to a wall of said pores charged by said electrical field to remove said charged particles from said gas passing therethrough.

2. An electrostatic dust collector according to claim 1, wherein said filter element is formed of three narrow elongated strips of pliable porous dielectric material superimposed, in face to face contact one on the other so that no air gap exists between said face to face strips, and said electrodes are disposed on surfaces between said strips.

3. An electrostatic dust collector wherein an electrode is formed on a gas barrier film on at least one surface of a narrow strip of a pliable porous dielectric filter material, a gas barrier film is formed over said electrode, a plurality of said narrow strips having electrodes covered by gas barrier films being superimposed one on the other so that said pliable porous dielectric filter material fills the space between the gas barrier films and electrodes with no air gap therebetween and gas is passed through said porous dielectric filter material parallel to said gas barrier films from a voltage source connected to the electrodes through respective terminal thereof is applied to the pliable porous dielectric material by said electrode to charge said particles and the walls of the pores therein and attract said charged particles and the walls of the pores therein and attract said charged particles to said charged walls and remove said attracted particles from said gas passing through said charge pliable porous dielectric material to remove particles from said gas.

4. An electrostatic dust collector according to claim 3, wherein said electrode on each said narrow strip is formed by adhering a metal film to said surface of said strip and said surface, with said metal film thereon, is coated with said gas barrier coating.

5. An electrostatic dust collector according to claim 3, wherein said electrode on each said narrow strip is formed by applying a gas barrier film to one surface of said narrow strip, a metal electrode is vaporized on said film, and said gas barrier coating is applied to said narrow strip over said metal electrode.

* * * * *